United States Patent [19]

Morozumi

[11] 4,348,996

[45] Sep. 14, 1982

[54] SYSTEM FOR CONTROLLING AIR-FUEL RATIO

[75] Inventor: Takuro Morozumi, Fuchu, Japan

[73] Assignees: Fuji Jukogyo Kabushiki Kaisha, Tokyo; Nissan Motor Co., Ltd., Kanagawa, both of Japan

[21] Appl. No.: 174,376

[22] Filed: Aug. 1, 1980

[30] Foreign Application Priority Data

Aug. 2, 1979 [JP] Japan ..... 54-98923

[51] Int. Cl.[3] ..... G06G 7/70; F02M 7/00; F02M 1/12; F02B 3/00

[52] U.S. Cl. ..... 123/440; 123/489; 123/491; 261/39 E

[58] Field of Search ..... 123/440, 489, 491, 443; 60/276, 285; 261/39 E

[56] References Cited

U.S. PATENT DOCUMENTS

| | | | |
|---|---|---|---|
| Re. 29,741 | 8/1978 | Norimatsu et al. | 123/440 |
| 3,763,837 | 10/1973 | Orlando | 261/39 E |
| 3,949,551 | 4/1976 | Eichler et al. | 123/491 |
| 4,003,350 | 1/1977 | Eisele et al. | 123/489 |
| 4,007,720 | 2/1977 | Brettenschnieder et al. | 123/440 |
| 4,109,615 | 8/1978 | Asano | 123/440 |
| 4,173,956 | 11/1979 | Ikeura et al. | 123/440 |

*Primary Examiner*—Raymond A. Nelli
*Attorney, Agent, or Firm*—Martin A. Farber

[57] ABSTRACT

A system for controlling the air-fuel ratio for an internal combustion engine having an induction passage, an exhaust passage, a choke valve in the induction passage, an automatic choke device comprising a positive temperature coefficient (PTC) heater and a bimetal element connected to the choke valve, a detector for detecting the concentration of a constituent of exhaust gases passing through the exhaust passage, an electronic control circuit, an on-off type electromagnetic valve actuated by the output signal from the electronic control circuit for correcting the air-fuel ratio of the air-fuel mixture supplied by an air-fuel mixture supplier, and means for actuating the on-off type electromagnetic valve at a fixed duty ratio during cold engine operation. The electronic control circuit comprises a vacuum sensor for converting the amount of the induced air to an electric quantity, an engine temperature detector for converting the engine temperature to an electric quantity, a first calculating circuit for producing a proper desired air-fuel mixture ratio signal from the output signals of the vacuum sensor and of the engine temperature detector, and a second calculation circuit for producing an actual air-fuel ratio signal from output signals of the vacuum sensor and of the PTC heater. A summing circuit for summing the proper air-fuel ratio signal and the actual air-fuel ratio signal produces a pulse duty ratio correcting signal which is applied to the electronic control circuit for correcting the fixed duty ratio.

6 Claims, 3 Drawing Figures

SYSTEM FOR CONTROLLING AIR-FUEL RATIO

BACKGROUND OF THE INVENTION

The present invention relates to a system for controlling the air-fuel ratio of a mixture to a proper value during cold engine operation.

Feedback control systems for controlling the air-fuel ratio are known in the internal combustion engine emission control system art with a three-way catalyst. In one of such system, as in U.S. Pat. No. 4,132,199, an oxygen sensor for sensing the oxygen content of the exhaust gases and an electronic control circuit are provided for actuating an on-off type electromagnetic valve in dependency on the output voltage of the oxygen sensor to adjust the air-fuel ratio of the mixture to the stoichiometric air-fuel ratio. The output voltage of the oxygen sensor varies according to the temperature of the sensor device. More particularly, when the temperature of the sensor device is lower than a certain level, the output voltage is too low to operate the electronic control circuit for controlling the air-fuel ratio. Consequently, in such a cold condition, the feedback control system is rendered ineffective and driving pulses having a fixed pulse duty ratio is fed to the on-off type electromagnetic valve for providing a lean air-fuel mixture. On the other hand, an automatic choke device is provided to correct the lean air-fuel mixture to a proper air-fuel ratio according to the engine temperature for improving the operability of the cold engine.

The automatic choke device is adapted to close the choke valve by a spiral bimetal element in dependency on the cold engine temperature and to progressively open the choke valve as the temperature rises.

If however the speed of the engine is increased by opening the throttle valve in the choke valve closed condition, the amount of air induced into the engine increases. Accordingly the choke valve closed by the automatic choke device is irregularly opened or closed by the increased amount of air. As a result, the air-fuel mixture changes to an excessively lean or rich air-fuel ratio.

SUMMARY OF THE INVENTION

The object of the present invention is to provide a control system which can correct the variation of the air-fuel ratio during cold engine operation.

According to the present invention, a system is provided for controlling air-fuel ratio for an internal combustion engine having an intake passage thereto, and an exhaust passage therefrom, a choke valve in the intake passage, an automatic choke device comprising a positive temperature coefficient (PTC) heater and operatively adjacent to a bimetal element operatively connected to said choke valve, detecting means for detecting the concentration of a constituent of gases passing through said exhaust passage, air-fuel mixture supply means for supplying an air-fuel mixture to the intake passage, an electronic control circuit, and electromagnetic valve means actuated by an output signal from said electronic control circuit means for correcting the air-fuel ratio of the air-fuel mixture supplied by said air-fuel mixture supply means, the improvement comprising induced air detecting means for providing an electric quantity output signal corresponding to the amount of induced air in the intake passage, engine temperature detecting means for providing an electric quantity output signal corresponding to the temperature of the engine, and calculating means for calculating output signals from said PTC heater, said induced air detecting means and said engine temperature detecting means and for producing a correcting signal, said electronic control circuit comprising means for correcting the signal to be applied to said electromagnetic valve means by said correcting signal to correct the air-fuel ratio to a proper air-fuel ratio.

Other objects and features of the present invention will become apparent from the following description of a preferred embodiment with reference to the accompanying drawings.

DETAILED DESCRIPTION OF THE PREFERRED EMBODIMENT

Figure 1:
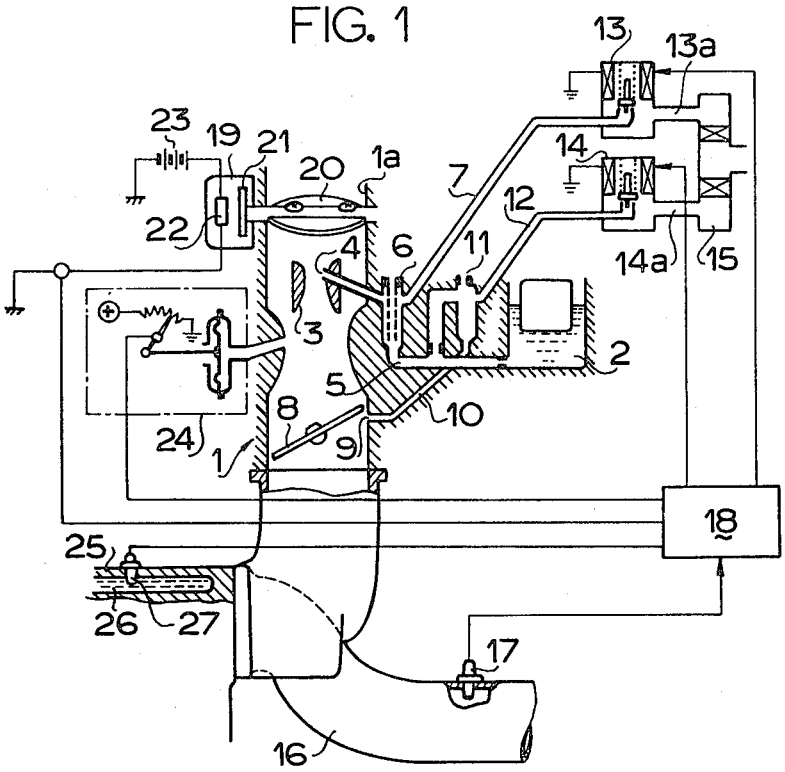
FIG. 1 is a schematic view of a system for controlling the air-fuel ratio according to the present invention.

Referring to FIG. 1, a carburetor 1 communicates with an internal combustion engine 25. The carburetor comprises a float chamber 2, an induction passage 1*a* in which there are disposed a venturi 3, a nozzle 4 communicating with the float chamber 2 through a main fuel passage 5, and a slow port 9 provided near a throttle valve 8 communicating with the float chamber 2 through a slow fuel passage 10. Air correction passages 7 and 12 are provided parallel to a main air bleed 6 and a slow air bleed 11, respectively. On-off type electromagnetic valves 13 and 14 are provided for the air correction passages 7 and 12, respectively. An inlet port 13*a* and 14*a*, respectively, of each on-off electro-magnetic valve communicates with the atmosphere through an air filter 15. An oxygen sensor 17 is disposed in an exhaust pipe 16 for detecting the oxygen content of the exhaust gases and for providing a signal corresponding thereto. A three-way catalytic converter (not shown) is provided in the exhaust pipe 16 downstream of the oxygen sensor 17.

An automatic choke device 19 is provided to adjust a choke valve 20 in the induction passage 1*a*. The automatic choke device 19 comprises a positive temperature coefficient (PTC) heater 22 and a spiral bimetal element 21 which is heated by the heater 22. The PTC heater 22 is connected to a battery 23. The resistance of the PTC heater 22 is low in the cold and increases with increasing temperature. Thus, in the cold, the choke valve 20 which is operatively connected to the bimetal element 21 is closed and progressively opens by the operation of the bimetal element 21 as the temperature increases.

A vacuum sensor 24 is provided for detecting the vacuum in the venturi, that is for detecting the amount of induced air. The vacuum sensor comprises a diaphragm 24*a* communicating with the venturi vacuum upstream of the throttle valve 8 and mechanically connected to a potentiometer 24*b*.

In addition, a thermosensor 27 is provided on a water jacket 26 of the engine for detecting the temperature of the cooling water of the engine.

Figure 3:
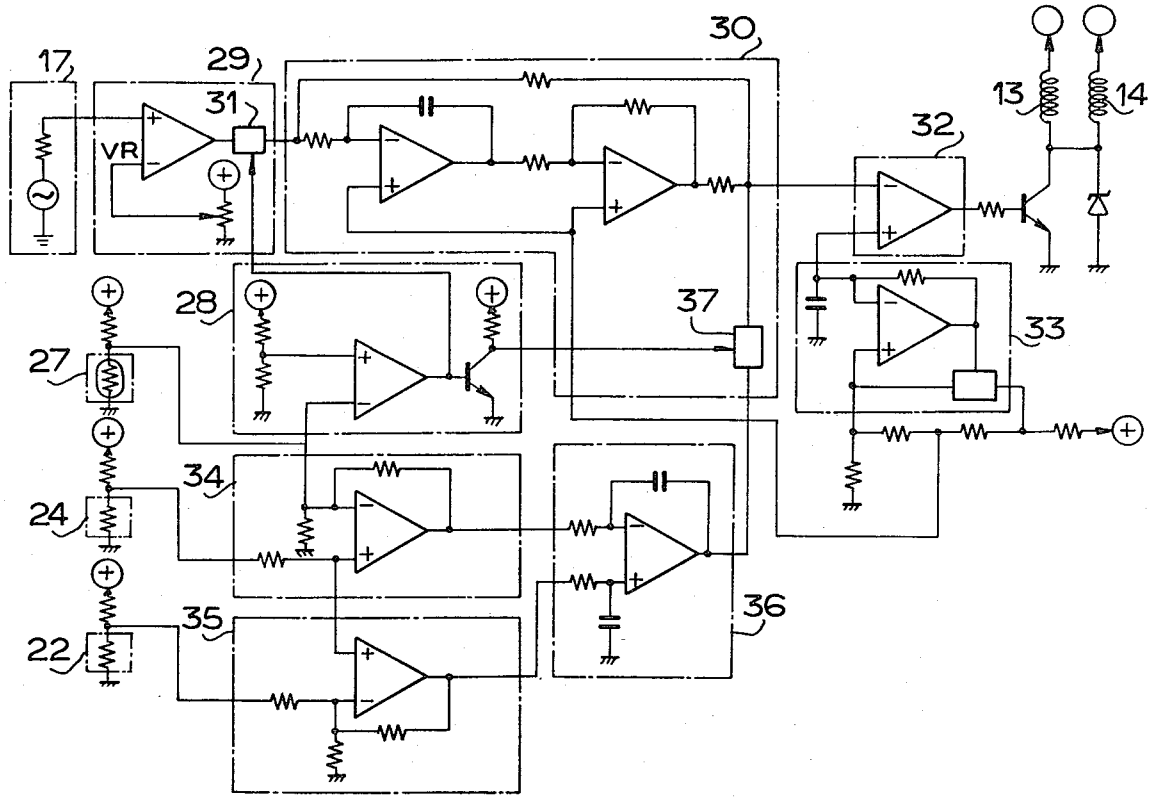
FIG. 3 is an electric circuit showing an electronic control system.
Figure 3:
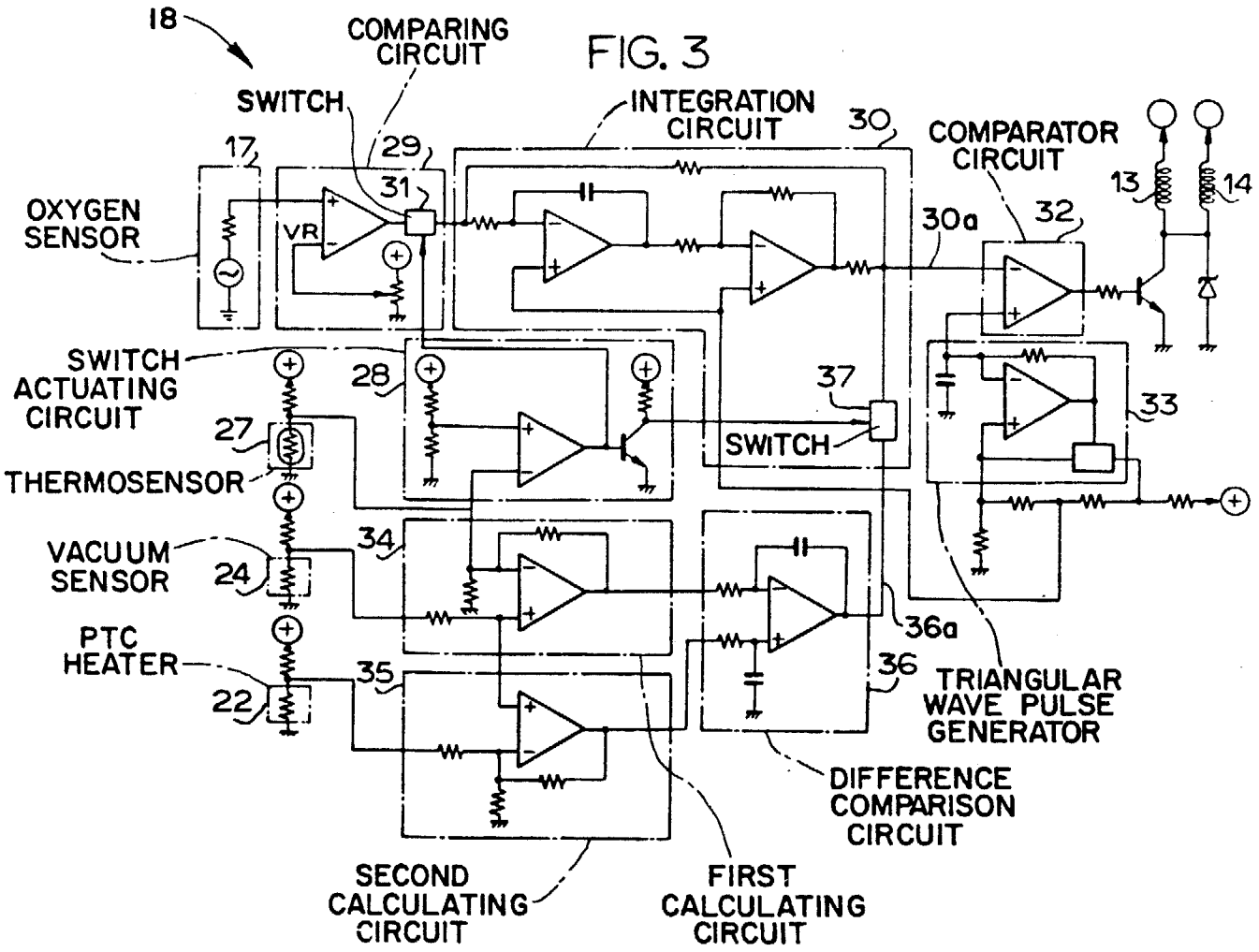

Referring to FIG. 3, the thermosensor 27 is connected to a switch actuating circuit 28 of an electronic control circuit 18 as shown in FIG. 3.

The output signal of the oxygen sensor 17 is applied to a comparing circuit 29 of the electronic control circuit 18. The comparing circuit 29 operates to compare the output signal of the oxygen sensor 17 with a built-in reference value $V_R$ corresponding to the stoichiometric air-fuel ratio and to determine whether the output signal is rich or lean compared with the reference stoichiometric air-fuel ratio to produce a detected signal. The detected signal is applied to an integration circuit 30 through a switch 31 when the latter is closed. In the integration circuit 30 the signal is converted to a integration signal which varies inversely, that is in an opposite direction to the direction represented by the detected signal. The integration signal in line 30*a* is compared in a comparator circuit 32 with triangular wave pulses applied from a triangular wave pulse generator 33 so that square wave pulses are produced to operate the on-off type electromagnetic valves 13 and 14.

When a rich air-fuel ratio is detected, the comparator circuit 32 produces an output pulse having a greater pulse duty ratio so that the amount of air passing through the on-off type electromagnetic valves 13 and 14 increases by the increased opening time periods of the valves. Thus, the amount of air in the air-fuel mixture fed from the carburetor 1 increases to thereby increase the air-fuel ratio. When a lean air-fuel ratio is detected, an output pulse signal having a smaller pulse duty ratio is produced and sent to the valves, wherby the air-fuel ratio decreases so as to enrich the mixture.

As shown in FIG. 3, the voltage output signals of both the thermosensor 27 and the vacuum sensor 24 are applied to a first calculating circuit 34. In the calculating circuit 34, a proper desired air-fuel ratio is obtained by calculating the cooling water temperature and the amount of induced air. On the other hand, output voltages of the vacuum sensor 24 and the PTC heater 22 are applied to a second calculating circuit 35. The actual air-fuel ratio of the induced mixture is obtained by calculating the amount of the induced air by the vacuum sensor 24 and the output from the PTC heater 22 which represents the degree of opening of the choke valve 20. Both outputs of the first and second calculating circuits 34 and 35 are fed to a difference comparison circuit 36, where the signal representing the actual air-fuel ratio is compared with the signal representing the proper desired air-fuel ratio for producing a correction signal via line 36*a*. The output of the circuit 36 is connected to the comparator circuit 32 via a switch 37.

When the output voltage of the thermosensor 27 exceeds a predetermined level, outputs of the switch actuating circuit 28 are inverted with respect to each other (the transistor performing an inversion), so that the switch 31 is opened and the switch 37 is closed. Thus, the integration circuit 30 is inoperative and the correcting signal from the circuit 36 is fed to the comparator circuit 32 via the switch 37. Consequently, a corrected proper ratio signal is produced from the comparator circuit 32. Thus, the on-off type electromagnetic valves 13 and 14 are operated at the corrected proper pulse duty ratio, so that a mixture having a proper air-fuel ratio can be supplied to the engine.

Figure 2:
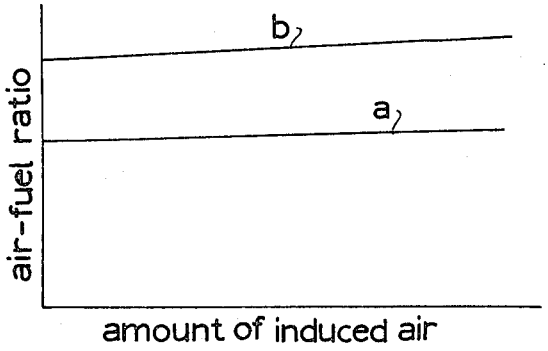
FIG. 2 is a graph showing variation of the air-fuel ratio vs. the amount of induced air.

FIG. 2 shows the variation of the air-fuel ratio versus the amount of the induced air according to the present invention in the cold engine operation. The line "a" shows a variation at a lower temperature of the cooling water and "b" shows a variation at a higher temperature. From the graph it will be observed that the air-fuel ratio is substantially constant.

The amount of the induced air can be detected by any other device such as a speed meter or a vacuum sensor for detecting vacuum in the intake passage.

In accordance with the present invention since the air-fuel ratio of the mixture in the cold engine operation may be corrected, the operability of the engine and the fuel consumption can be improved and a desirable emission control can be accomplished.

What is claimed is:

1. In a system for controlling air-fuel ratio for an internal combustion engine having an intake passage thereto and a throttle valve disposed in the latter, an exhaust passage therefrom, an automatic choke device including a choke valve in the intake passage, a positive temperature coefficient (PTC) heater, and a bimetal element operatively connected to said choke valve, detecting means for detecting the concentration of a constituent of gases passing through said exhaust passage, air-fuel mixture supply means for supplying an air-fuel mixture to the intake passage, an electronic control circuit, and electromagnetic valve means actuated by an output signal from said electronic control circuit for correcting the air-fuel ratio of the air-fuel mixture supplied by said air-fuel mixture supply means, the improvement comprising a venturi provided in said intake passage upstream of the throttle valve, a vacuum sensor means for detecting actual flow rate of induced air in said venturi and for providing an electric quantity output signal corresponding to the actual flow rate of induced air in the intake passage, engine temperature detecting means for providing an electric quantity output signal corresponding to the temperature of the engine, means for producing an output signal dependent on the current passing through said PTC heater, calculating means for calculating the output signals from said engine temperature detecting means, said vacuum sensor means and said calculating means for producing a correcting signal and for operatively applying said correcting signal to the electromagnetic valve means to correct the air-fuel ratio to a proper air-fuel ratio.

2. In a system for controlling air-fuel ratio for an internal combustion engine having an intake passage thereto and a throttle valve disposed in the latter, and an exhaust passage therefrom, a choke valve in the intake passage, an automatic choke device comprising a positive temperature coefficient (PTC) heater and operatively adjacent to a bimetal element operatively connected to said choke valve, detecting means for detecting the concentration of a constituent of gases passing through said exhaust passage, air-fuel mixture supply means for supplying an air-fuel mixture to the intake passage, an electronic control circuit, and electromagnetic valve means actuated by an output signal from said electronic control circuit for correcting the air-fuel ratio of the air-fuel mixture supplied by said air-fuel mixture supply means, the improvement comprising a vacuum sensor means for detecting the vacuum in a venturi provided in said intake passage upstream of said throttle valve for providing an electric quantity output signal corresponding to the actual flow rate of induced air in the intake passage, engine temperature detecting means for providing an electric quantity output signal corresponding to the temperature of the engine, means for producing an output signal dependent on the current passing through said PTC heater, first calculating circuit means for producing a desired proper air-fuel ratio signal from said output signal of said vacuum sensor means and said output signal of said engine temperature detecting means, second calculating circuit means for producing an actual air-fuel ratio signal from the output signal of said vacuum sensor means and the output signal of said means for producing an output signal dependent on the current passing through said PTC heater, and means for comparing said proper air-fuel ratio signal and said actual air-fuel ratio signal and for producing a duty ratio correcting signal which is applied to said electronic control circuit.

3. The system as set forth in claim 2, wherein said electronic control circuit includes a switch actuating circuit means operatively connected to said engine temperature detecting means, said electronic control circuit includes a comparing circuit operatively connected to said detecting means, a comparator circuit having an output operatively connected to said electromagnetic valve means, an integration circuit connected between said comparing circuit and said comparator circuit, said switch actuating circuit means for operatively disconnecting said integration circuit and for connecting the output of said comparing means to said comparator circuit when the output signal of said engine temperature detecting means exceeds a predetermined level, whereby said integration circuit is inoperative and the duty ratio correcting signal is applied to said comparator circuit of said electronic control circuit.

4. The system as set forth in claim 3, wherein said switch actuating circuit means, said first calculating circuit means, said second calculating circuit means, said comparing means, said comparing circuit and said comparator circuit each include an operational amplifier.

5. The system as set forth in claim 4, wherein said operational amplifiers of said switch actuating circuit means and said first calculating circuit means respectively have common inputs connected jointly to said engine temperature detecting means, said operational amplifiers of said first calculating circuit and said second calculating circuit have different common inputs connected jointly to said vacuum sensor means, another input of said operational amplifier of said second calculating circuit is connected to said means for producing an output signal dependent on the current passing through said PTC heater.

6. The system as set forth in claim 5, wherein said switch actuating circuit means includes a fixed voltage input and a switching transistor means connected to an output of said operational amplifier of said switch actuating circuit means, a first switch connected to an output of said comparing means and having a gate connected to an output of said switching transistor means, said switch is connected to an input of said comparator circuit, a second switch connected between said comparing circuit and said integration circuit and having a gate connected to the output of said operational amplifier of said switch actuating circuit means.

* * * * *

UNITED STATES PATENT AND TRADEMARK OFFICE

CERTIFICATE OF CORRECTION

PATENT NO. : 4,348,996

DATED : Sept. 14, 1982

INVENTOR(S) : Takuro Morozumi

It is certified that error appears in the above-identified patent and that said Letters Patent is hereby corrected as shown below:

The title page should be deleted to appear as per attached title page.

Figures 1 and 3 of the drawings should be deleted to appear as per attached Figures 1 and 3.

Signed and Sealed this

*Twenty-second* Day of *March 1983*

[SEAL]

*Attest:*

GERALD J. MOSSINGHOFF

*Attesting Officer*

*Commissioner of Patents and Trademarks*

United States Patent [19]

Morozumi

[11] 4,348,996

[45] Sep. 14, 1982

[54] SYSTEM FOR CONTROLLING AIR-FUEL RATIO

[75] Inventor: Takuro Morozumi, Fuchu, Japan

[73] Assignees: Fuji Jukogyo Kabushiki Kaisha, Tokyo; Nissan Motor Co., Ltd., Kanagawa, both of Japan

[21] Appl. No.: 174,376

[22] Filed: Aug. 1, 1980

[30] Foreign Application Priority Data

Aug. 2, 1979 [JP] Japan ..... 54-98923

[51] Int. Cl.[3] ..... G06G 7/70; F02M 7/00; F02M 1/12; F02B 3/00

[52] U.S. Cl. ..... 123/440; 123/489; 123/491; 261/39 E

[58] Field of Search ..... 123/440, 489, 491, 443; 60/276, 285; 261/39 E

[56] References Cited

U.S. PATENT DOCUMENTS

| | | | |
|---|---|---|---|
| Re. 29,741 | 8/1978 | Norimatsu et al. | 123/440 |
| 3,763,837 | 10/1973 | Orlando | 261/39 E |
| 3,949,551 | 4/1976 | Eichler et al. | 123/491 |
| 4,003,350 | 1/1977 | Eisele et al. | 123/489 |
| 4,007,720 | 2/1977 | Brettenschnieder et al. | 123/440 |
| 4,109,615 | 8/1978 | Asano | 123/440 |
| 4,173,956 | 11/1979 | Ikeura et al. | 123/440 |

*Primary Examiner*—Raymond A. Nelli
*Attorney, Agent, or Firm*—Martin A. Farber

[57] ABSTRACT

A system for controlling the air-fuel ratio for an internal combustion engine having an induction passage, an exhaust passage, a choke valve in the induction passage, an automatic choke device comprising a positive temperature coefficient (PTC) heater and a bimetal element connected to the choke valve, a detector for detecting the concentration of a constituent of exhaust gases passing through the exhaust passage, an electronic control circuit, an on-off type electromagnetic valve actuated by the output signal from the electronic control circuit for correcting the air-fuel ratio of the air-fuel mixture supplied by an air-fuel mixture supplier, and means for actuating the on-off type electromagnetic valve at a fixed duty ratio during cold engine operation. The electronic control circuit comprises a vacuum sensor for converting the amount of the induced air to an electric quantity, an engine temperature detector for converting the engine temperature to an electric quantity, a first calculating circuit for producing a proper desired air-fuel mixture ratio signal from the output signals of the vacuum sensor and of the engine temperature detector, and a second calculation circuit for producing an actual air-fuel ratio signal from output signals of the vacuum sensor and of the PTC heater. A summing circuit for summing the proper air-fuel ratio signal and the actual air-fuel ratio signal produces a pulse duty ratio correcting signal which is applied to the electronic control circuit for correcting the fixed duty ratio.

6 Claims, 3 Drawing Figures

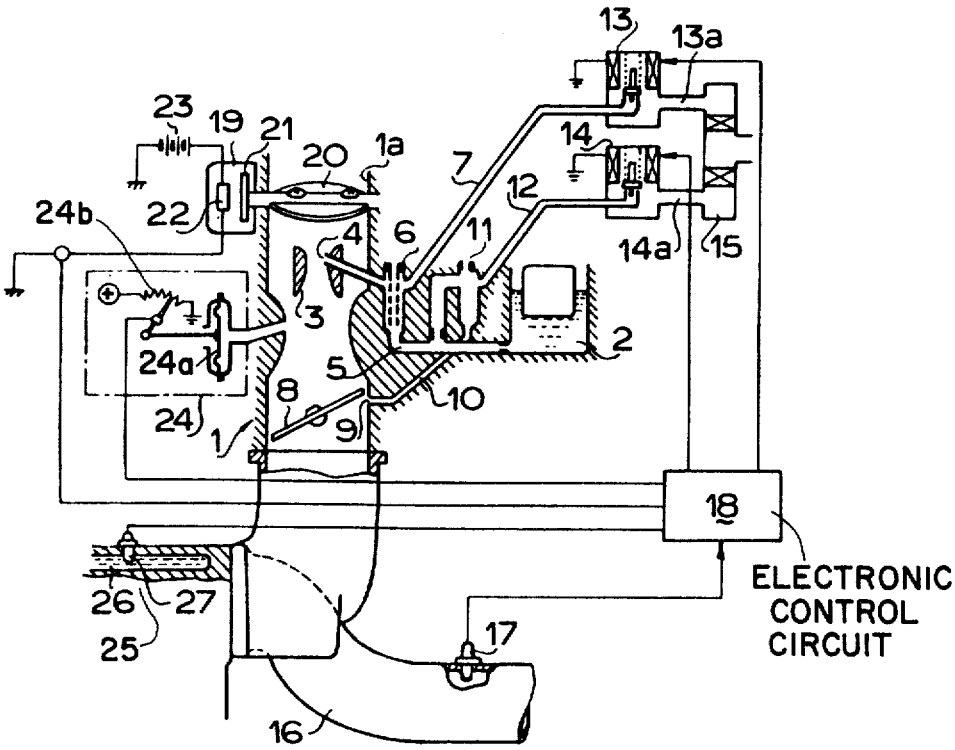

UNITED STATES PATENT AND TRADEMARK OFFICE

CERTIFICATE OF CORRECTION

PATENT NO. : 4,348,996

DATED : Sept. 14, 1982

INVENTOR(S) : Takuro Morozumi

It is certified that error appears in the above-identified patent and that said Letters Patent is hereby corrected as shown below:

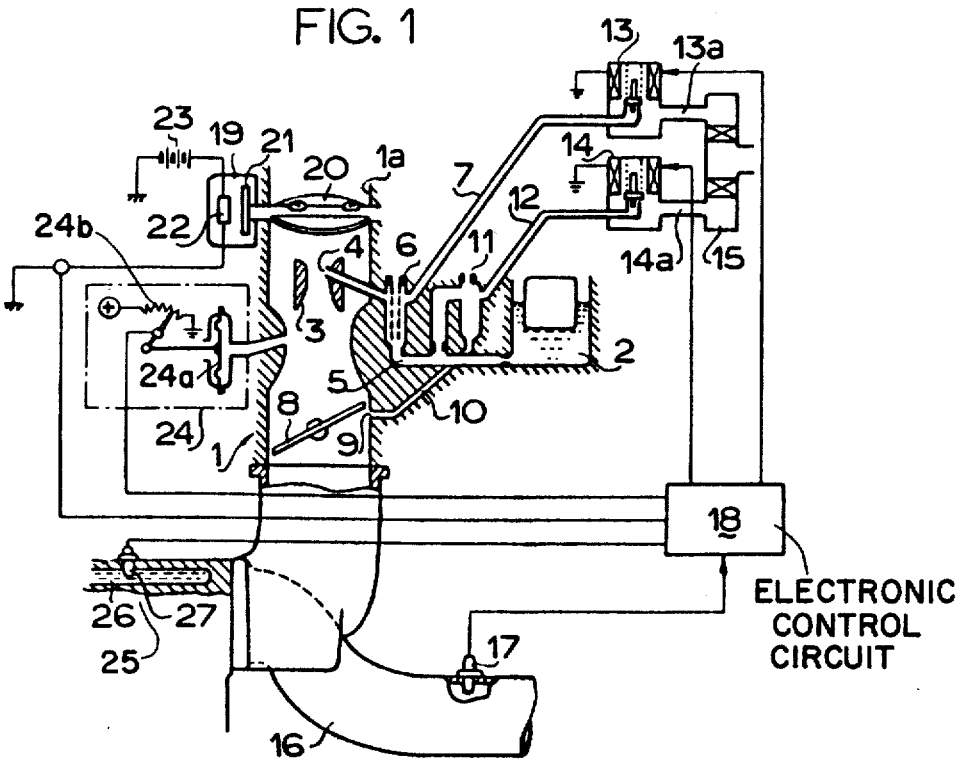

FIG. 1